US005797071A

United States Patent [19]

Ozawa et al.

[11] Patent Number: 5,797,071

[45] Date of Patent: Aug. 18, 1998

[54] ELECTROPHOTOGRAPHIC APPARATUS

[75] Inventors: Yoshio Ozawa; Norio Tomiie; Hiroyoshi Tode; Yukio Ikeda, all of Watarai-gun, Japan

[73] Assignee: Kyocera Corporation, Kyoto, Japan

[21] Appl. No.: 757,737

[22] Filed: Nov. 26, 1996

[30] Foreign Application Priority Data

Nov. 2, 1995 [JP] Japan ..... 7-334163
Nov. 29, 1995 [JP] Japan ..... 7-334114

[51] Int. Cl.[6] ..... G03G 15/00

[52] U.S. Cl. ..... 399/159; 430/56; 430/66; 430/127

[58] Field of Search ..... 399/159; 430/56, 430/66, 110, 111, 127

[56] References Cited

U.S. PATENT DOCUMENTS

| | | | |
|---|---|---|---|
| 4,673,629 | 6/1987 | Yamazaki et al. | 430/66 X |
| 4,675,265 | 6/1987 | Kazama et al. | 430/66 X |
| 4,764,448 | 8/1988 | Yoshitomi et al. | 430/110 X |
| 4,770,966 | 9/1988 | Kazama et al. | 430/66 |
| 4,794,064 | 12/1988 | Yamazaki et al. | 430/66 X |
| 4,833,055 | 5/1989 | Kazama et al. | 430/66 |
| 5,159,393 | 10/1992 | Hiroshima et al. | 399/313 |
| 5,612,160 | 3/1997 | Inoue et al. | 430/110 |

FOREIGN PATENT DOCUMENTS 62-272275 11/1987 Japan .

*Primary Examiner*—Matthew S. Smith
*Attorney, Agent, or Firm*—Loeb & Loeb LLP

[57] ABSTRACT

To form sharp image free from flow of image or fog with an electrophotographic apparatus, which uses an a-Si photosensitive drum charged uniformly by having resort to the discharge phenomenon, the electrophotographic apparatus comprises an electrophotographic photo-sensitive drum having a surface layer being represented by an elementary ratio composition formula ( a-$Si_{1-x}C_x$:H ), x being $0.95 \leqq x < 1$, the dynamic indentation hardness of the upper surface layer being 300 kgf/mm$^2$ or below, the hardness of said surface layer being higher on the inner side of said photoconductive layer than on the outer surface side, preferably being gradually increasing as one goes toward the inner side of said photoelectric layer from the outer surface side, and a developing unit using a developer composed of carrier and toner particles being caused to rub the drum surface and recovered said developer in a developer vessel. The temperature of said photosensitive drum surface and said developer vessel being held in a range 0 to +10° C., the developer used for the development contained a conductive abrasive having a volume resistivity ranging from $10^2$ to $10^{10}$ Ω·cm, the peripheral speed of a transfer roller is set to be slightly higher than the peripheral speed of the drum.

11 Claims, 2 Drawing Sheets

FIG. 1A
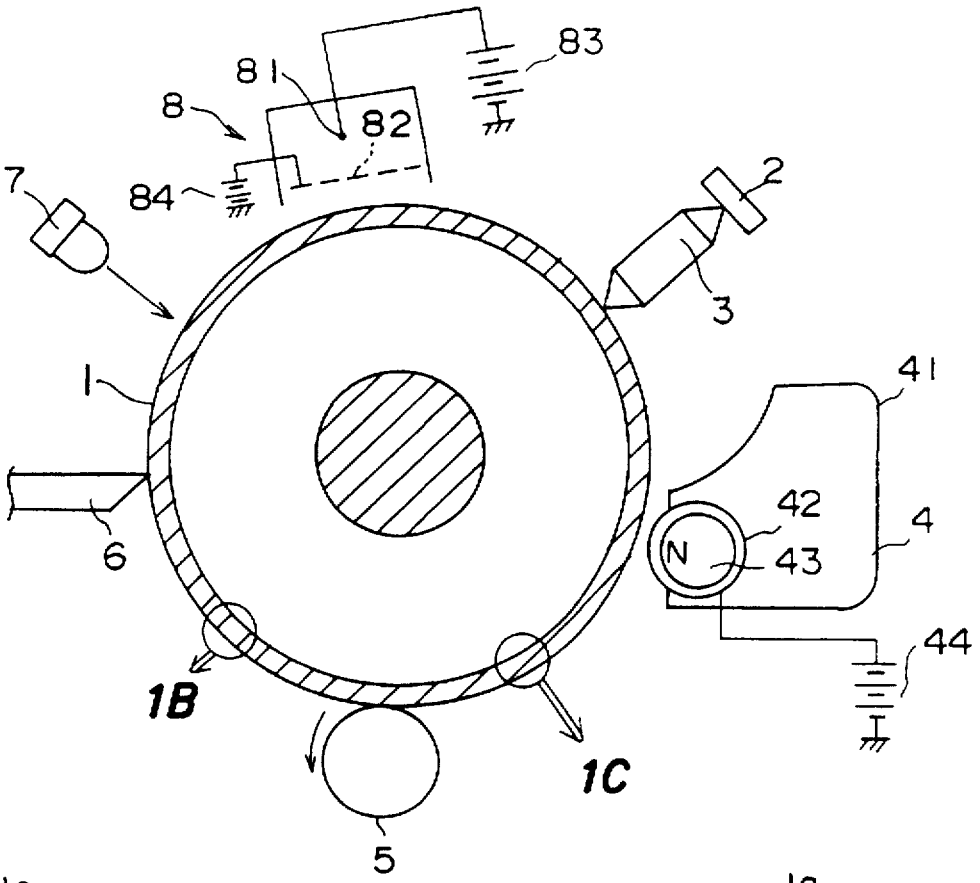
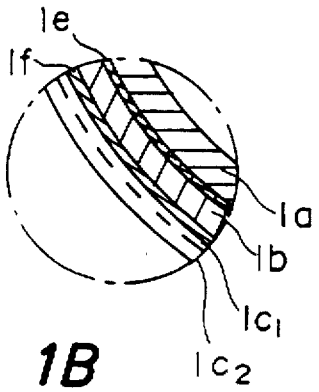
FIG. 1B
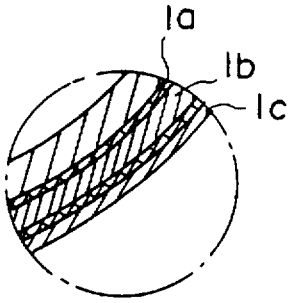
FIG. 1C 10,000 prints 100,000 prints

ELECTROPHOTOGRAPHIC APPARATUS

BACKGROUND OF THE INVENTION

1. Fields of the Invention

This invention relates to such electrophotographic apparatuses as printers, copiers, facsimile apparatuses, etc. using amorphous Si drums.

2. Description of the Prior Art

A well-known electrophotographic apparatuses perform a commonly termed Curlson process, i.e., it forms images by predetermined electrophotographic process with exposing, developing, transferring, cleaning (i.e., residual toner removing), discharging, charging and other processing means disposed around the outer periphery of a photo-sensitive drum.

In this electrophotographic apparatus, the photo-sensitive drum is usually charged uniformly by utilizing corona discharge. The corona discharge, however, usually has to be done by applying a high voltage of 4 to 8 KV or above by wire application and the application of such a high voltage by corona discharge causes oxidation of the photo-sensitive drum and generation of ozone, as well as resulting in the generation of such discharge products as oxygen nitride and ammonium salt. These substances are adsorbed to the drum surface to cause ready flow of image. Pronounced flow of image is caused remarkably in high humidity environments.

To overcome this drawback, a roller charging system has been proposed. The system uses a conductive drum, which is held in contact with the conductive roller on the photo-sensitive drum so as to apply it with a DC voltage by contact charging in darkness.

Even such a charging system, however, is subject to discharge phenomenon, due to slightly wedge-like interstices that are formed between the photo-sensitive drum and a charging roller. Ozone is therefore generated, as has been recognized, disabling complete overcoming of the above drawback.

To overcome those drawback, a technique used above charging means with particle charging means has been proposed. The particle charging means, however, requires a charging vessel being accommodating charging particles in such a situation having an opening facing the drum. Therefore, it is complicated to deal with the charging vessel. Besides, the particles should always been charged uniformly in frictional contact with the photo-sensitive drum, thus resulting are fatigued in long use. This means poor durability of the particle charging means.

At present, most techniques of charging the photo-sensitive drum use corona dischargers or charging rollers.

Recent electrophotographic apparatuses use amorphous Si drums as the photo-sensitive drum in order to improve the durability and make the maintenance unnecessary. However, amorphous Si highly absorbs moisture compared to OPC and other organic semiconductors, and amorphous Si drums apt to generate more flow of image.

To prevent the flow of image, the photo-sensitive drum is heated by a sheet heater or like heating member provided on its back side.

Where the heater is used, however, heat control means or the like has to be provided and complicates the system construction. Particularly, when a copier, a printer, etc. is to be reduced in size or personalized, the system construction complication by providing the heater is inevitable. The heater poses a further problem that its temperature elevation requires a certain time, i.e., a considerably long time (warm-up time), from the instant of the power-"on" till it is ready to start the printing. Besides, this warm-up time means corresponding power consumption. Moreover, the photo-sensitive drum is heated to raise its temperature up to the neighborhood of the TG temperature (glass transition temperature) of the toner, thus such various problems generate as resulting in toner attachment to its surface.

To overcome the above drawbacks, various techniques have been developed, concerning the photo-sensitive drum, particularly a surface layer thereof.

For example, Japanese Laid-Open Patent Publication No. 62-272275 proposes a photo-sensitive drum, which uses a surface layer covering an amorphous Si photoconductive layer. The surface layer is made of an amorphous material mainly composed of silicon (Si) and carbon (C) and containing oxygen (O), hydrogen (H) and fluorine (F) and has a dynamic indentation hardness of 300 to 1,000 kgf/mm$^2$.

The dynamic indentation hardness is set in the above range for the following grounds. With a dynamic indentation hardness exceeding 1,000 kgf/mm$^2$, the surface layer has a so high Si content that it is subject to chemical influence and gives rise to the image defect as noted above. With a dynamic indentation hardness lower than 300 kgf/mm$^2$, on the other hand, the surface layer has a high C content, deteriorating the photoconductivity and increasing residual potential. Moreover, the hardness is considerably reduced to increase the wear of the surface layer in an image copying process and readily give rise to image defect.

In emphasis, the prior art techniques discussed above pose the following problems.

First, the techniques realize commonly called heater-less photo-sensitive drums by taking only the drum surface layer into considerations. However, the flow of image is caused not only by the surface layer but also is determined by the relation between the photo-sensitive drum and the developing means, the transferring means and other processing means.

This means that various difficulties are involved in realizing the commonly termed heater-less photo-sensitive drum by specifying only the surface layer thereof.

The above disclosed technique seeks to prevent the flow of image particularly due to high humidity rise while avoiding the wear of the photo-sensitive drum surface layer. The flow of image, however, is caused by reduction of the photo-sensitive drum surface layer potential with drum surface resistance reduction in a high humidity environment, which is attributable to an increase of the moisture absorption of the photo-sensitive drum surface due to drum surface deterioration and attachment to the drum surface of discharge products caused by ozone generation due to the discharge phenomenon when charging the drum. The discharge products are attached to the drum surface layer contrived in any way, and accumulated while the photo-sensitive drum is in use. Thus, the generation of the flow of image depends on the accumulation degree of the attached substances, making it difficult to ensure stable image formation for long time.

To overcome this drawback, Japanese Laid-Open Patent Publication No. 61-278861 proposes a technique, in which the photo-sensitive drum surface is cleaned by using a cleaning material as cleaning auxiliary agent. The cleaning material is prepared by adding to the developer strontium titanate having the reversed polarity of charging to the toner. The reversed polarity strontium titanate, however, is a highly resistive or insulating dielectric. Therefore, it causes instable charging of the toner during the development and fog or like image defect.

To provide a heater-less photo-sensitive drum, the applicant has proposed in Japanese Laid-Open Patent Publication No. 7-17526 an electrophotographic apparatus, in which a photoconductive layer supported on a base is charged uniformly by means including discharge phenomenon while writing on the charged photoconductive layer an exposure image, a toner image is formed by inverse development.

Specifically, the photoconductive layer of the amorphous Si photo-sensitive drum as noted above is formed as an amorphous Si layer with a thickness of 25 μm or below, preferably 2 to 20 μm, and the surface potential of approximately 360 V or below is generated by charging the layer.

Again this technique does not take the relationship between the surface layer and the photoconductive layer into considerations and it is not sufficient. Besides, the surface potential is limited to approximately 360 V or below. This imposes great restrictions on applications of the technique to systems other than a commonly termed low electric field developing system.

The present invention was made in the light of the above drawbacks inherent in the prior art, and has an object of providing an electrophotographic apparatus, which permits formation of sharp images without flow of image or fog particularly with an amorphous Si photo-sensitive drum which is charged uniformly by means including such discharge phenomenon as specially a corona charger, a charging roller or a charging brush.

Another object of the invention is to provide an electrophotographic apparatus, which can be used for long time with a developer incorporating a cleaning auxiliary agent or an abrasive to form sharp images.

A further object of the invention is to provide an electrophotographic apparatus using an amorphous Si drum, which permits formation of sharp images without flow of image or fog irrespective of temperature or like environmental condition changes, as well as permitting simplification of the construction and reinforcement of the stability.

SUMMARY OF THE INVENTION

First, the cause of generation of the flow of image in the case of using the amorphous Si photo-sensitive drum will be described.

As shown in the enlarged-scale showing in FIG. 1, the amorphous Si photo-sensitive drum has a photoconductive layer 1*b* and a surface layer 1*c*, these layers 1*b* and 1*c* being laminated on a conductive base 1*a* in the form of an aluminum cylinder. The surface layer 1*c* is made of an α-SiC type inorganic highly resistive or insulating material to maintain the surface potential $V_O$ and latent image potential distribution on the photoconductive layer 1*b*.

Therefore, during the electrophotographic process discharge products such as ion nitrate and ammonium ions generated by corona discharge, are adsorbed to the surface layer 1*c* and cause surface-wise movement of latent image charge, which is formed on the surface layer 1*c* on the basis of the surface potential $V_O$ and latent image potential distribution on the photoconductive layer 1*b* in an high temperature, high relative humidity environment. Flow of charge, i.e., flow of image, is generated in this way. Another conceivable cause of the flow of image is the fact that the photo-sensitive drum surface is oxidized and deteriorated to become hydrophilic in a continuous printing operation.

In order to prevent the flow of image and obtain sharp image, it is necessary to study the relation the photo-sensitive drum and the developer.

In the above electrophotographic apparatus, a highly resistive or insulating toner is used for the developer to develop the latent image. When the toner in this case contains dew condensation or moisture, its attachment to the photo-sensitive drum surface layer 1*c* results in the generation of flow of image.

The invention seeks to provide an electrophotographic apparatus, which permits formation of sharp images without flow of image or fog, by effectively combining the photoconductive layer 1*b*, surface 1*c* and developing conditions.

This object of the invention is attained by an electrophotographic apparatus, in which a photo-sensitive drum having a photoconductive layer and a surface layer, these layers being laminated on a base, and a latent image formed on above photo-sensitive drum is developed by causing selective attached toner, the apparatus comprising:

an electrophotographic photo-sensitive drum provided as the above photo-sensitive drum with the surface layer thereof being represented by an elementary ratio composition formula ( $a\text{–}Si_{1-x}C_x$:H ), x being $0.95 \leqq x < 1$, the dynamic indentation hardness of the upper surface layer on the upper surface side thereof being 300 kgf/mm$^2$ or below, the hardness of the surface layer being higher on the inner side of the photoconductive layer than on the outer surface side, preferably gradually increasing as one goes toward the inner side of the photoconductive layer from the other surface; and a developer unit using a developer including a carrier and toner particles, the developer being caused to rub the surface of the photo-sensitive drum and recovered it in a developer vessel;

the difference between the temperature of the photo-sensitive drum surface and the temperature of the developer vessel being held in a range of 0 to +10°C.

Suitably, the surface layer 1*c* has a dynamic indentation hardness of 50 to 200 kgf/mm$^2$ on the surface side, and has a thickness of 0.4 to 1.2 μm, preferably 0.5 to 0.8 μm. Where the surface layer 1*c* is formed as one having a two-layer structure, suitably a second sub-layer which is formed on the outer surface side has a dynamic indentation hardness of 50 to 200 kgf/mm$^2$ and a thickness of 800 to 3,000 Å (angstroms), and a first sub-layer formed on the inner or bottom side is harder than the second sub-layer.

With this arrangement, it is possible to obtain image formation without flow of image at the ambient temperature in the apparatus, which has no heater inside the base supporting the photoconductive layer 1*b*. The photo-sensitive drum surface temperature is thus held approximately 0 to +10° C. to above the developer vessel inner temperature.

Where a two-component developer is used, a problem is posed from the exceeding of 0 to +10° C. by the difference between the temperature of the developer just recovered in the developer vessel after rubbing the photo-sensitive drum surface and the temperature of the developer having been in the developer vessel. In this case, dew condensation may result from the contact of the two developers at the different temperatures under a high humidity condition.

The rubbing of the photo-sensitive drum by the developer with the dew condensation promotes the generation of discharge products.

Contact-less development with a uni-component developer gives rise to a similar problem since the toner rubs the photo-sensitive drum surface during the development.

The above phenomenon may occur when the above temperature difference is attributable to a high temperature of the developer (i.e., developer vessel). According to the invention, the photo-sensitive drum surface temperature is accordingly held approximately 0 to +10° C. above the temperature in the developer vessel.

However, in-order to smoothly attain the object of the invention by maintaining the above temperature difference, the photo-sensitive drum surface layer is polished in an initial stage of the image formation.

The prevention of the moisture absorption of the photo-sensitive drum from the developer side, is not enough to solve the problem. Since the photo-sensitive drum surface layer 1*c* is formed by glow discharge decomposition or the like, discharge products such as ion nitrate and ammonium ions generated by corona discharge are adsorbed to molecule ends or the like in micro-interstices on the surface of the surface layer 1*c*, thus giving rise to the above problem.

According to the invention, the surface layer 1*c* is polished in order to remove the discharge products which may be adsorbed in an initial stage of the image formation. To enable the polishing, the dynamic indentation hardness of the surface layer 1*c* is set to 300 kgf/mm$^2$ or below on the surface side.

It is also possible to use a rubbing roller, a cleaning blade, etc. as well as the toner and an abrasive added thereto as polishing means caused to polish the photo-sensitive drum surface layer 1*c* having the micro-interstices at least in those initial stage for the image formation.

According to the invention, the hardness of the surface layer 1*c* is made to increase as one goes inward toward the inner side of the photoconductive layer 1*b* from the surface side. In consequence, the grinding rate can be reduced progressively as one goes inward, and this enables maintaining long life or high durability. By the polishing the surface is smoothed, that is, the molecule ends and micro-interstices noted above are removed, so that it is possible to suppress the adsorption of the discharge products.

According to the invention, to suppress oxide film generation on the amorphous Si photo-sensitive surface layer 1*c* by corona discharge, the content of amorphous carbon in the surface layer 1*c* is set to be as high as that the surface layer being represented by an elementary ratio composition formula ( a–$Si_{1-x}C_x$:H ), x being $0.95 \leqq x < 1$.

According to the invention, it is an essential prerequisite to smooth the surface of the surface layer 1c by polishing the same. When using an abrasive for the polishing, it is suitable to select the grain size in a range of 0.05 to 5 μm, preferably 0.1 to 3 μm.

The relation between the surface layer 1*c* and the photoconductive layer 1*b* considered.

Even by the covering of the surface layer 1*c* the adsorption of discharge products cannot be perfectly prevented, and this has to be made up for on the side of the photoconductive layer 1*b*.

Particularly, where the photo-sensitive drum is heaterless, its temperature depends on the temperature in the apparatus. This means that it is necessary that no great photo-sensitive surface potential changes are caused by temperature changes.

As shown in FIG. 2, where the photo-sensitive drum surface potential is 800 V or below, the thickness of the photoconductive layer 1*b* covered by the surface layer 1*c* is preferably 50 μm or below.

It has been confirmed that while the thickness can be reduced proportionally with reducing photo-sensitive drum surface potential, the photo-sensitive surface potential is not changed greatly, for instance by about 10%, with a temperature change by reducing the surface potential to around 400 V and setting the photo-sensitive drum thickness to about 40 μm.

It is possible to increase the photo-sensitive drum surface potential to 800 V or above. However, such great surface potential increase undesirably leads to a charging control voltage increase and a corresponding generated ozone increase, leading to proportional increase of the adsorption of discharge products.

In the case of an amorphous Si photo-sensitive material, the breakdown voltage of its layer is 12 to 16 V/μm. With the thickness set to 50 μm or below, it is thus possible to suppress the flow of image and prevent the breakdown voltage deterioration in long use by setting the surface potential $V_0$ to 800 V, preferably 600 V or below.

In the case of using an amorphous Si type material for the photoconductive layer 1*b*, by reducing the thickness it is possible to obtain a given surface potential $V_0'$ with less optical output. However, development with even a low electric field requires a surface potential of about 50 V. From the consideration of the breakdown voltage the lower limit of the thickness is approximately 3 μm.

In applications to LEDs or like exposing means with wavelengths around 700 nm, the lower limit of the thickness is suitably set to 2 to 3 μm, because of the fact that the thickness of, for instance, an a-Si:H layer corresponding to 90% absorption of incident light is about 2.2 μm.

According to the invention, image formation without fog or the like is obtainable without use of any heater. It is thus possible to greatly reduce power consumption. Besides, since no heater is used, it is not necessary to use such components as a thermistor for detecting the drum surface temperature and a controller for controlling any heater according to the temperature detected by such a thermistor. The circuit construction thus can be simplified. Moreover, no heater warm-up time is needed, thus greatly reducing the start time of the apparatus.

As described before, Japanese Laid-Open Patent Publication No. 61-278861 shows a technique employing developing means, which is constructed such as to perform development by causing a developer incorporating an abrasive to rub the photo-sensitive drum and has a polishing function to remove discharge products. The abrasive incorporated, however, is a highly resistive or insulating material having the opposite charging polarity to the toner. Therefore, in the development it makes the charge on the toner unstable, thus resulting in such image detect as fog.

As described above, in the prior art the abrasive particles are made finer than the toner particle size, and this finer particle abrasive and an aggregate thereof are used to provide a cleaning effect. This means that the abrasive is attached together with toner to the photo-sensitive drum. Since the downstream side transfer step executes electrostatic transfer with an applied bias voltage of the opposite polarity to the toner, the abrasive is transferred together with toner and causes such image sharpness reduction as white spots or white areas.

In the meantime, according to the invention the abrasive has an adequate particle size with respect to the toner and is conductive, and it is held on the toner in the development. Thus, it does not remain so much in the developing unit.

The conductive abrasive used according to the invention is effectively prevented from being transferred in the transfer step.

Specifically, a further feature of the invention resides in an electrophotographic apparatus, in which a photo-sensitive drum having a photoconductive layer and a surface layer, these layers being laminated on a base, and a latent image formed on above photo-sensitive drum is developed by selective attached toner, the apparatus comprising;

developing means for developing said latent image with a developer incorporating a conductive abrasive with a volume resistivity ranging from $10^2$ to $10^{10}$ Ω·cm; and a electrophotographic photo-sensitive drum as the above photo-sensitive drum, at least the surface side of the surface layer having a hardness in a range of permitting the polishing by the abrasive.

As the conductive abrasive (or abrasive particles) may be used silicon carbide (SiC), magnetite ($Fe_3O_4$), tin oxide ($SnO_2$), tin carbide (TiC) and inorganic particles obtained by treating highly resistive particles to be conductive. These abrasive are by no means limitative.

As described above, the conductive abrasive suitably has a grain size of 0.05 to 5 μm, preferably 0.1 to 3 μm.

According to the invention, the resistivity of the abrasive is set to $10^2$ to $10^{10}$ Ω·cm. When the resistivity of the transferred material exceeds $10^{10}$ Ω·cm, the transfer efficiency of the transfer process after the development is quickly reduced as is well known in the art. When the resistivity is no higher than $10^2$ Ω·cm, the charging property of the toner is too poor to obtain sufficient developing performance, although depending on the amount of the abrasive added.

After the transfer, the abrasive reaches a toner scraper of a cleaning blade together with the toner, and is partly scraped off while partly being held on the end of the blade and continuing the polishing. A rubbing roller may be effectively provided in front of the cleaning blade to hold the toner and the abrasive on its surface and rub the photo-sensitive drum with the abrasive having been held, thus effecting the polishing.

In this case, it is possible to obtain more effective cleaning by setting slightly higher peripheral speed of the transfer roller than the one of photosensitive drum.

As shown above, by using the conductive abrasive as specified above it is possible to obtain smooth development, transfer and cleaning.

Particularly, according to the invention the transfer roller is rotated at a slightly higher peripheral speed than the peripheral speed of the photo-sensitive drum to obtain effective separation of the toner and the abrasive during the transfer.

In the transfer process, the back side of a transfer medium is held at a high potential to cause transfer of toner from the photo-sensitive drum to the transfer medium. At this time, the abrasive particles which have been brought together with toner to the drum, are suitably not readily transferred compared to the toner, and its great proportion remains on the drum surface and is suitably removed by the cleaning means in the subsequent step while polishing the drum surface.

This function is attributable to the low resistivity of the toner and also to the optimum particle size ratio between the toner and the abrasive (i.e., cleaning particle).

When the abrasive particles are too small compared to the toner particles, they are readily held on the toner particle surface and moved with the toner during the development and transfer. Consequently, less abrasive remains on the photo-sensitive drum surface after the transfer. When the abrasive particles are too large, white spots and white areas are generated in the image area by the abrasive particles having been transferred to the drum. When the particle size ratio between the toner and the abrasive is adequate, no white spot or white area or like image defect is generated, and much abrasive particles can be held on the drum surface after the transfer.

According to the invention, the particle size range and proportion of the abrasive particles are defined accordingly; the average particle size ratio between the toner and the abrasive in the developer is set in a range of 100:1 to 2:1, more preferably 50:1 to 3:1, and the abrasive particles are added in a range of 0.3 to 5% to the toner in the developer.

With this arrangement, it is possible to obtain image formation without flow of image at the ambient temperature in the apparatus, which has ho heater inside the base supporting the photoconductive layer.

As described above, the surface layer of the photo-sensitive drum is represented by an elementary ratio composition formula ( a-$Si_{1-x}C_x$:H ), x being $0.95 \leqq x < 1$, and has a dynamic indentation hardness of 300 kgf/mm$^2$ or below, the hardness of the surface layer being higher on the inner side of the photoconductive layer than on its outer surface side and preferably gradually increasing as one goes inward from the outer surface side toward the inner side of the photoconductive layer. Suitably, the surface layer 1*c* has a dynamic indentation hardness of 50 to 200 kgf/mm$^2$ on its outer surface side and a thickness of 0.4 to 1.2 μm, preferably 0.5 to 0.8 μm. Where the surface layer has a two-layer structure, suitably a second sub-layer on the upper surface side has a dynamic indentation hardness of 50 to 200 kgf/mm$^2$ and a thickness of 800 to 3,000 nm, and the first layer on the inner side is harder than the second sub-layer on the surface.

BRIEF DESCRIPTION OF THE DRAWINGS

FIG. 1 is a schematic view showing an electrophotographic apparatus, to which the invention is applied.

Figure 2A:
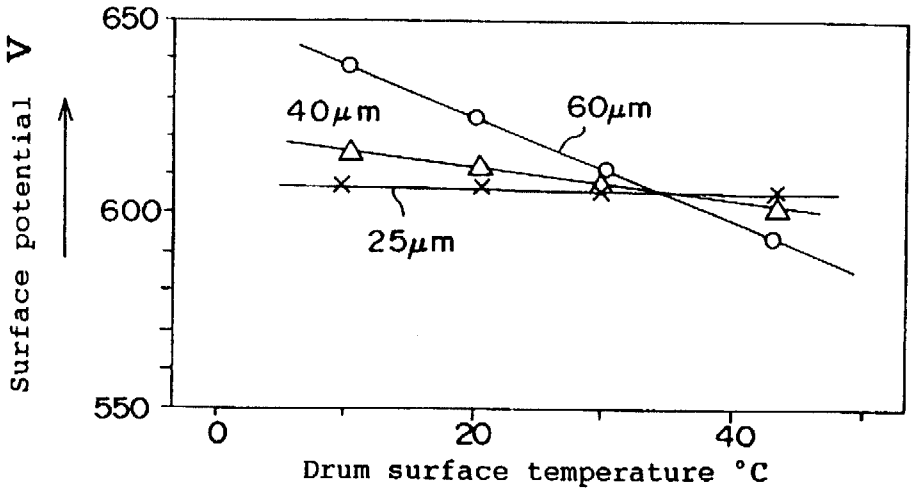
FIG. 2 shows graphs showing the relation between the surface potential and temperature of an a-Si photo-sensitive drum with a constant charging control bias with the drum thickness taken as parameter when 10,000 and 100,000 prints have been produced.

In the figures, designated at 1 is a photo-sensitive drum, at 1*a* a conductive base, 1*b* a photoconductive layer, at 1*c* a surface layer, $1c_1$, a first sub-layer, $1c_2$ a second sub-layer, 2 an exposing head, 3 an optical system, 4 a two-component developing unit, 41 a developer vessel, and 3 a charging unit.

DETAILED DESCRIPTION OF THE PREFERRED EMBODIMENT

An embodiment of the invention will now be described in detail. It is to be construed that unless particularly specified the sizes, materials, shapes and relative dispositions of parts described in connection with the embodiment are by no means limitative but are merely exemplary.

Referring to FIG. 1, an electrophotographic apparatus is shown, to which the invention is applied. In the apparatus, an optical system including an LED exposing head 2 and a cellfox lens 3, a developing unit 4, a transfer roller 5, a cleaning blade 6, a discharging lamp 7, and a charging unit 8, are disposed around an a-Si photo-sensitive drum 1, which rotates clockwise in the figure, in the mentioned order in the rotating direction.

The constituent elements of the apparatus will now be described individually.

The photo-sensitive drum 1 has a photoconductive layer 1b and a surface layer 1*c*, these layers 1*b* and 1*c* being laminated on a photoconductive base or support 1*a*, a carrier injection prevention layer 1*e* intervening between the conductive support 1*a* and the photoconductive layer 1*b*, and a transition layer 1*f* intervening between the photoconductive layer 1*b* and the surface layer 1*c*.

The support 1*a* is cylinder having an aluminum character, made of such a metallic material as SUS, Ti, Ni, Au, Ag, etc., an inorganic material such as glass with a conductive surface film, a transparent resin such as epoxy or the like. In this embodiment, the support 1*a* has a thickness of 3 mm, an outer diameter of 30 mm and an axial length dimension of 254 mm.

The carrier injection prevention layer 1*e* may be made of various materials depending on the material of the photoconductive layer 1*b*. Where the photoconductive layer 1*b* is made of an amorphous Si type material, the carrier injection prevention layer 1*e* is suitably made of like amorphous Si type material.

The amorphous Si type photoconductive layer 1*b* is formed a glow discharge decomposition process, a sputtering process, an ECR process, a deposition process or like process. It suitably contains 5 to 40% by weight of a dangling bond end element, such as hydrogen (H) or a halogen, introduced in its formation.

Specifically, the photoconductive layer 1*b* is made of a photoconductor represented as a-Si:H. Where the developing bias is positive, the layer 1*b* is suitably non-doped or doped with a Va family element to increase the mobility of electrons. Where the developing bias is negative, it suitably contains a IIIa family element to increase the mobility of positive holes. If necessary, it may contain such element as C, O, N, etc. to obtain desired electric characteristics such as dark conductivity or photoconductivity, optical band gap, etc.

The thickness of the entirety of the photoconductive layer 1*b* is suitably 3 to 50 μm in view of ensuring the necessary charging voltage or breakdown voltage or absorption of exposure light or suppressing the residual potential noted above. Why this is so will be described later.

The surface layer 1*c* is formed by a glow discharge decomposition process, a sputtering process, an ECR process, a deposition process or the like. It is made of hydroxidic amorphous silicon carbide represented by an elementary ratio composition formula ( $a\text{-}Si_{1-x}C_x:H$ ), x being $0.95 \leqq x < 1$, and has a dynamic indentation hardness of 50 to 200 kgf/mm$^2$ on its outer surface (or free surface layer). Particularly, it has a resistivity of $10^{12}$ to $10^{13}$ Ω·cm.

The hardness of the surface layer 1*c* is increased gradually as one goes inward from the outer surface side toward the inner side of the photoconductive layer 1*b*.

Such a hardness gradient (that the hardness is increased as one goes inward from the outer surface side toward the side of the photoconductive layer 1*b*), may be provided when forming the surface layer 1*c* by, for instance, the glow discharge decomposition process by such means as gradually increasing the ratio of C-containing gas to Si-containing gas in the material gas, gradually increasing the layer formation gas pressure, gradually reducing the factor of dilution of the material gas by hydrogen gas, gradually reducing the discharge power, or gradually reducing the temperature of the aluminum character cylinder drum base.

The surface layer 1*c* suitably has a thickness of 0.4 to 1.2 μm, preferably 0.5 to 0.8 μm.

As will be described later, the surface layer 1*c* is polished. For this reason, with a thickness below 0.4 μm a sufficient hardness gradient cannot be obtained. Therefore, the durability is insufficient, and image streaks or the like are generated when the number of prints is increased. With a thickness above 1.2 μm the residual potential on the side of the photoconductive layer 1*b* is so high as to cause fog or like image detect.

The transition layer 1*f*, which has less C content in a-SiC:H than the surface layer 1*c*, is suitably provided between the photoconductive layer 1*b* and the surface layer 1*c*.

It is possible to vary the C content such as to provide a C content gradient in the transition layer 1*f*. The provision of such a transition layer 1*f* makes the movement of optical carriers in the photoconductive layer 1*b* smoother, thus increasing the optical sensitivity, reducing the residual potential and improving image characteristics.

The thickness of the transition layer 1*f* is set to 1 μm or below, preferably 0.05 to 0.5 μm.

The surface layer 1*c* may have a two-layer structure instead of the uni-layer structure.

For example, the surface layer 1*c* may comprise a first sub-layer $1c_1$ on the side of the photoconductive layer 1*b* and a second sub-layer $1c_2$ on the upper or free surface side. Suitably, the second sub-layer $1c_2$ is represented by a elementary ratio composition a formula ($a\text{-}Si_{1-x}C_x:H$), x being $0.95 \leqq x < 1$, has a dynamic indentation hardness of 50 to 200 kgf/mm$^2$, and a thickness of 800 to 3,000 angstroms. Suitably, the inner side first layer $1c_1$ is harder than the second sub-layer $1c_2$. Specifically, the dynamic indentation hardness of the first sub-layer $1c_1$ is 300 kgf/mm$^2$ or above. With this hardness, the sub-layer is capable of being polished by abrasive or the like without being worn out.

Polishing means, cleaning means, a magnetic brush formed in the development or the like, which is independent for each process, adequately polishes the second sub-layer $1c_2$ to remove discharge products adsorbed thereto. The polishing is stopped by the inner side first sub-layer 1*c*1 in its stage, in which the surface has been smoothed. Thus, life extension can be obtained.

The total thickness of the first and second sub-layers $1c_1$ and $1c_2$, i.e., the thickness of the surface layer 1*c*, is set to 0.4 to 1.2 μm, preferably 0.5 to 0.8 μm.

The carrier injection prevention layer 1*e* may be made of various materials depending on the material of the photoconductive layer 1*b*. Where an amorphous Si type material is used for the photoconductive layer 1*b*, like amorphous Si type material is suitably used for the carrier injection prevention layer 1*e*.

In an embodiment of the invention, the a-Si:H photoconductive layer 1*b* and the SiC surface layer 1*c* are laminated by using a capacitance-coupled glow discharge decomposition process. As examples, the photo-sensitive drum 1 was fabricated by setting the thickness of the photoconductive layer 1*b* to 15, 25, 40 and 60 μm as will be described later. In these examples, the surface layer 1*c* was formed only with a uni-layer structure layer without forming a two-layer constructure layer, and its thickness was set to 0.6 μm.

The LED exposing head 2 is fabricated as a head array with an exposure wavelength of 685 nm and driven by dynamic driving for time-division exposure of 40 times 64 bits for each scanning line.

The developing unit 4 includes a developer vessel 41 accommodating a multi-component developer composed of carrier and toner, and a developing roller 42 accommodating a stationary magnet 43. For the development, a DC developing bias power supply 44 capable of setting a selected bias voltage between 50 to 1200 V, for instance, is connected to the developing roller 42. According to the invention, the two-component developer is by no means limitative.

As the transfer roller 5 a conductive roller is used to increase the transfer efficiency. The transfer roller 5 is biased by a transfer bias of the reversed polarity to the toner charging potential, and is rotated in uniform forced contact with the periphery of the photo-sensitive drum 1. It is rotated at one of two speeds, that is, it is rotated either in synchronism to the drum 1 (transfer step in contrast examples) or at a slightly higher peripheral speed, specifically by 1 to 5%, than the peripheral speed of the drum 1 (transfer step in embodiment examples).

The charging unit 8 is a well-known corotron charger to uniformly charge the photo-sensitive drum 1. In the figure, reference numeral 81 designates a corona charger electrode, 82 a control grid, 83 a discharge bias, and 84 a charging control bias.

In the examples described below, the photo-sensitive drum 1 was charged to a surface potential $V_0$ shown below by applying a high discharge bias voltage with the charging control bias set to an adequate value in a range of around 150 to 1,200 V, and then exposed to a predetermined latent image by the exposing head 2, and the latent image thus formed developed in the developing unit 4 to obtain a toner image which was then transferred to the transfer roller 5.

Then, by using such apparatus together with a developer and setting the surface potential $V_0$ on the photo-sensitive drum 1 to 600 V by the charging control bias, etc., the transfer voltage applied to the transfer roller back surface side was set to −800 V, slightly higher than the drum surface potential by holding the charging control bias constant. For the peripheral speed of the transfer roller is set to be higher by about 1% than the peripheral speed of the drum.

Example 1 (using a two-component developer):

Toner composition:

Styrene acryle resin: 100 constructive ratio

Nygrocin dye: 3 constructive ratio

Polypropyrene wax: 5 constructive ratio

Carbon black: 8 constructive ratio

The mixture of this composition was fused and kneaded using a two-axis extruder. The mixture was then cooled down and coarsely commuted to a medium particle size. The particles were then finely commuted by jet mill to obtain toner with an average particle size of 7 μm.

To this toner were added 0.5% of hydrophobic silica and 2% of SiC abrasive with a particle diameter of 0.35 μm and a resistivity of $10^3$ Ω·cm (particle size ratio to toner of 1:20). The admixture was kneaded using a Henshell mixer.

The two-component developer was prepared by mixing 5 constructive ratio of the toner thus obtained and 95 constructive ratio of a carrier. The developer was used with the image forming apparatus as described above, and image evaluation was made.

First, 50,000 prints were produced under the ordinary environmental conditions, and then left under conditions of 32.5° C. and 80% for 10 hours. Then, the flow of image was checked for by taking out samples, and it was not observed. The drum surface was also checked, and not scar or scratch or surface change was observed.

Example 2 (using a uni-component developer):

Toner composition:

Styrene acryle resin: 100 constructive ratio

Magnetite: 50 constructive ratio

Polypropyrene wax: 5 constructive ratio

Nigrocin dye: 3 constructive ratio

Using the mixture of this composition a toner with an average particle size of 7 μm was prepared by the same test as in Example 1. To this toner were added 0.5% of hydrophobic silica and one constructive ratio of conductive $TiO_2$ abrasive with a particle size of 0.7 μm (particle size ratio of 1:10) and a resistivity of $10^5$ Ω·cm, and the admixture was kneaded using a Henshell mixer.

Using this toner with the above image forming apparatus, 50,000 prints were produced in a uni-component developing process under the ordinary environmental conditions, and then left for 10 hours before image evaluation under condition of 32.5° C. and 80%. No abnormality was observed. The drum surface was also checked, and no scars or scratch or like defect was observed.

Example 3 (using a uni-component developer):

The same experiment as in Example 2 was conducted except for adding 2% of TiC abrasive with a particle size of 0.2 μm and a resistivity of $10^3$ Ω·cm. No abnormality of image and drum surface was observed.

Contrast Example 1 (using a uni-component developer):

Image evaluation was made in the same manner as in Example 2 for adding, in lieu of the $TiO_2$ abrasive, the same amount of $SiO_2$ with a particle size of 0.5 μm and a resistivity of $10^{12}$ Ω·cm. Sharp image could not be obtained due to generation Of flow of image. Also, cloud was formed on the drum surface.

Contrast Example 2 (using a uni-component developer):

Image evaluation was made in the same manner as in Example 2 for using, in lieu of the $TiO_2$ abrasive, the same amount of strontium titanate with a particle size of 1 μm and a resistivity of $10^{12}$ Ω·cm. Sharp image could not be obtained due to generation of flow of image.

Contrast Example 2 (using a uni-component developer):

The same test as in Example 2 was made except for using a $TiO_2$ abrasive with a particle size of 4 μm (particle size ratio of 1:1.75) and a resistivity of $10^4$ Ω·cm. Full image with white spots was produced.

A further experiment was conducted by using the developer in Example 1. In this test, the surface potential $V_0$ on the photo-sensitive drum 1 was set to 600 V by adjusting the charging control bias, etc. and then the transfer voltage applied to the transfer roller back surface side was set to −800 V, slightly higher than the drum surface potential by holding the charging control bias constant. In the transfer process, the peripheral speeds of the drum and the transfer roller were synchronized. Full image with slight white spots was produced, and the image sharpness was reduced compared to the case of Example 2.

Still further experiments were conducted using photo-sensitive drums 1 with different thicknesses of the photo-conductive layer **1*b***.

In the experiments, a two-component developer composed of a toner and a carrier was used. The carrier was a ferrite carrier with an average particle size of 70 μm. The ferrite carrier, however, is by no means limitative, and may be replaced with such carriers as iron particles, magnetite, etc., or magnetic resin carriers.

The toner used as magnetic toner was a highly resistive or insulating toner, which was formed by adding a binder resin, a coloring agent, a charge control agent, an anti-off-set agent, etc. to a magnetic material and had an average particle size of 5 to 15 μm. This toner was used to obtain three different toners, i.e., A toner (hereinafter referred to as A toner) incorporating an abrasive (hereinafter referred to as A abrasive) added a conductive titanium oxide, as an abrasive/fluidity promoter having a specific surface area of 40 to 60 $m^2/g$, a resistivity of $10^3$ Ω·cm, a hydrophobic degree of 0%, a water content of 1.0%, surface treatment Sd doping of $SiO_2$ and an average particle size 0.1 μm. B toner (hereinafter referred to as B toner) incorporating an abrasive (hereinafter referred to as B abrasive) as a conductive titanium oxide having a specific surface area of 10 to 15 $m^2/g$, a resistivity of $10^3$ Ω·cm, a hydrophobic degree of 0%, a water content of 0.5%, surface treatment doping of $SiO_2$ and an average particle size of 0.3 μm, and C toner (hereinafter referred to as C toner) free from any incorporated abrasive. The adequate mixture ratio between the carrier and the toner was set to 85~90 to 15~10% by weight.

The effect of the invention was confirmed with respect to the A toner as follows. The surface potential $V_0$ on the photo-sensitive drum 1 was set to 450 V, the developing bias was set to 250 V, and the temperature of the developer in the developer vessel 41 was set to 20° C. by providing a heater (not shown) in the developer vessel 41. In this state, the apparatus was left for more than 2 hours in a room, which was held at temperatures of 10, 20, 25 and 30° C. respectively under a medium relative humidity set by an air conditioner, and then 10,000 prints were produced at each temperature of the apparatus noted above. In the case of the apparatus temperature of 10° C., slight flow of image was generated in an initial printing stage up to 10,000 prints. In the other apparatus temperature cases of 20, 25 and 30° C., no image defect was produced.

Then, using a 25 μm photo-sensitive drum without providing any heater in the photo-sensitive drum and in the developer vessel, after setting the drum surface potential $V_0$ to 450 V and setting the developing bias to 250 V, printing was done while varying the apparatus temperature from 10 to 40° C. with a gradient of 10° C./hour under the medium relative humidity. Sharp image with neither flow Of image nor fog could be obtained.

Figure 2B:
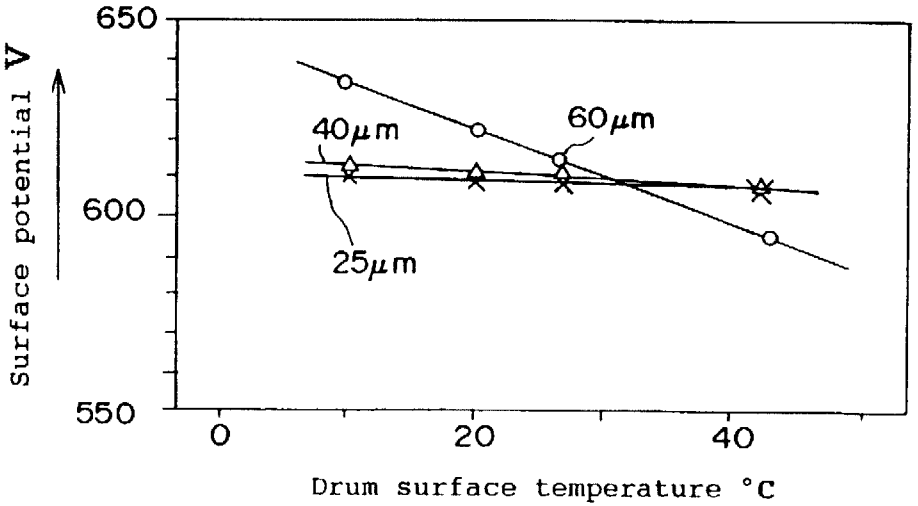

Yet further experiments were conducted using 25 μm, 40μm and 60 μm a-Si photo-sensitive drums as the photo-sensitive drum 1 with the LED exposing head noted above together with a developer containing the A toner. The drum surface potential $V_0$ was set to 600 V by adjusting the charging control bias or the like, and the energy level of image focusing on the drum was set to 1.0 $\mu J/cm^2$ by adjusting the output of the exposing head 2. The apparatus temperature was set to 10, 20, 30 and 43° C. under the medium relative humidity by holding the charging control bias constant. FIG. 2 shows the relation between the surface potential $V_0$ on and the temperature of the drum with the thickness thereof taken as a parameter after production of 10,000 and 100,000 prints.

As will be seen from the figure, with the photo-sensitive drum with the thickness of the photoconductive layer **1*b* set to 60 μm, the temperature dependency was high, and slight temperature gradient was observed after production of even 100,000 prints. With the photo-sensitive drums with the thickness of the photoconductive layer 1*b*** set to 40 and 25 μm, on the other hand, no substantial temperature gradient was produced, indicating great reduction of the temperature dependency.

It is thus possible to suppress the drum surface potential variations with environmental condition variations by making the drum thinner to be 50 μm or below, preferably 40 μm or below.

Yet other experiments were conducted using a 40 μm photo-sensitive drum without any heater. By setting the drum surface potential $V_0$ to a higher value of 800 V, 300,000 prints were produced (substantially in 500 hours) while varying the apparatus temperature from 10° to 40° C. with a temperature gradient of 10° C./hour under the medium relative humidity. It was possible to obtain sharp image with neither flow of image or fog.

The effects of the toner confirmed with the B and C toners by using a 25 μm photo-sensitive drum were as follows. The drum surface potential $V_0$ was set to 450 V without providing any heater in the photo-sensitive drum, and printing was done while varying the apparatus temperature from 10° to 40° C. with a temperature gradient of 10° C./hour under the medium relative humidity. Slight flow of image was generated in an initial stage of production of 10,000 prints only in the case of the C toner free from abrasive, but no flow of image was observed at the end of production of 100,000 prints.

Yet another test was conducted using a 25 μm heater-less photo-sensitive drum with two different cleaning blades, i.e., one (B blade) made of a rubber material incorporating the B abrasive, and one (C blade) made of a rubber material incorporating an abrasive with an average particle size of 5 to 10 μm and besides having the same composition as the B abrasive. Printing was done using the C toner free from abrasive by using a 25 μm photo-sensitive drum, in which the drum surface potential $V_0$ was set to 450 V without providing any heater in the photo-sensitive drum at an apparatus temperature of 20° C. under the medium relative humidity. In the case of the C blade with the abrasive particle size of 5 to 10 μm, flow of image was generated after production of 300,000 prints. In the case of the B blade, no flow of image was produced.

As has been described in the foregoing, with the electrophotographic apparatus according to the invention, which uses an amorphous Si drum which is uniformly charged by means having resort to the discharge phenomenon, such as a corona discharger, a charging roller, or a charging brush, it is possible to obtain sharp image free from flow of image or fog.

According to the invention, with the electrophotographic apparatus, which uses an amorphous Si drum, it is possible to form a sharp image without fog or flow of image irrespective of such environmental condition change as temperature etc., taking into consideration simplification of the construction and reinforcement of the stability.

According to the invention, it is also possible to obtain sharp image formation for long time even with a developer incorporating a cleaning material or an abrasive.

What is claimed is:

1. An electrophotographic apparatus, in which a photo-sensitive drum having a photoconductive layer and a surface layer, said layers being laminated on a base, and a latent image formed on above photo-sensitive drum is developed by causing selective toner attachment, said electrophotographic apparatus comprising:

an electrophotographic photo-sensitive drum provided as said photo-sensitive drum with said surface layer thereof being represented by an elementary ratio composition formula ($a\text{-}Si_{1-x}C_x$:H), x being $0.95 \leqq x < 1$, the dynamic indentation hardness of said surface layer on the upper surface side thereof being 300 $kgf/mm^2$ or below, the hardness of said surface layer being higher on the inner side of said photoconductive layer than on the outer surface side; and a developing unit using a developer including a toner and abrasive being caused to rub the surface of said photo-sensitive drum and recovered said developer in a developer vessel;

the temperature of said photo-sensitive drum surface being held approximately in a range of 0 to +10° C. with respect to the temperature of said developer vessel.

2. The electrophotographic apparatus according to claim 1, wherein said electrophotographic layer is an amorphous Si layer having a thickness of 2 to 50 μm, and the surface potential of said photo-sensitive drum is set to approximately 800 V or below.

3. An electrophotographic apparatus, in which a photoconductive layer and a surface layer, said layers being laminated on a base, and a latent image formed on a photo-sensitive drum having is developed by causing selective toner attachment, said electrophotographic apparatus comprising:

an electrophotographic photo-sensitive drum provided as said photo-sensitive drum with said surface layer thereof being represented by an elementary ratio composition formula a-$Si_{1-x}C_x$:H ), being $0.95 \leqq x < 1$, the dynamic indentation hardness of said surface layer on the upper surface side thereof being 300 kgf/mm$^2$ or below, the hardness of said surface layer being higher on the inner side of said photoconductive layer than on the outer surface side, preferably gradually increasing as one goes toward the inner side of said photoconductive layer from the outer surface side; and a developing unit using a developer including a toner and abrasive being caused to rub the surface of said photoconductive drum and recovered said developer in a developer vessel;

the temperature of said photo-sensitive drum surface being held approximately in a range of 0 to +10° C. with respect to the temperature of said developer vessel, said surface layer of said photo-sensitive drum being formed the image while polishing at least in an initial stage of image formation.

4. An electrophotographic apparatus, in which a photoconductive layer and a surface layer, these layers being laminated on a base, and a latent image formed on a photo-sensitive drum having is developed by causing selective toner attachment, said electrophotographic apparatus comprising:

an electrophotographic photo-sensitive drum provided as said photo-sensitive drum with said surface layer thereof being represented by a elementary ratio composition formula a-$Si_{1-x}C_x$:H ), x being $0.95 \leqq x < 1$, the dynamic indentation hardness of said surface layer on the upper surface side thereof being 300 kgf/mm$^2$ or below, the hardness of said inner surface layer being gradually increasing as one goes toward the inner side of said photoconductive layer from the outer surface side.

a developing unit using a developer including a toner and abrasive being caused to rub the surface of said photo-sensitive drum and recovered said developer in a developer vessel;

the temperature of said photo-sensitive drum surface being held approximately in a range of 0 to +10° C. with respect to the temperature of said developer vessel.

5. The electrophotographic apparatus according to claim 4, wherein said developer contains in the range of 0.3 to 5% of said abrasive particle with respect to said toner.

6. An electrophotographic apparatus, in which a latent image formed on a photo-sensitive drum having a photoconductive layer and a surface layer, these layers being laminated on a base, is developed by causing selective toner attachment, said electrophotographic apparatus comprising:

developing means for developing said latent image with a developer incorporating a conductive abrasive with a volume resistivity ranging from $10^2$ to $10^{10}$ Ω·cm;

an electrophotographic photo-sensitive drum as said photo-sensitive drum, said surface layer thereof having, at least on the upper surface side, a hardness range being sufficient to permit its polishing by said abrasive, the hardness of said surface layer being higher on the inner side of said photoconductive layer than on the upper surface side.

7. The electrophotographic apparatus according to claim 6, wherein the average particle size ratio between said toner and said abrasive particle in said developer ranges from 100:1 to 2:1, preferably from 50:1 to 3:1.

8. An electrophotographic apparatus, in which a latent image formed on a photo-sensitive drum having a photoconductive layer and a surface layer, these layers being laminated on a base, is developed by causing selective toner attachment, said electrophotographic apparatus comprising:

developing means for developing said latent image with a developer incorporating a conductive abrasive with a volume resistivity ranging from $10^2$ to $10^{10}$ Ω·cm;

an electrophotographic photo-sensitive drum as said photo-sensitive drum, said surface layer thereof having, at least on the upper surface side, a hardness range being sufficient to permit its polishing by said abrasive, the hardness of said surface layer being higher on the inner side of said photoconductive layer than on the upper surface side; and transfer roller rotated at a slightly higher peripheral speed than the peripheral speed of said photo-sensitive drum.

9. The electrophotographic apparatus according to claim 8, wherein the back side of a transfer medium is held at a high potential with respect to the potential on said photo-sensitive drum surface in a transfer process.

10. An electrophotographic apparatus, in which a latent image formed on a photo-sensitive drum having a photoconductive layer and a surface layer, these layers being laminated on a base, is developed by causing selective toner attachment, said electrophotographic apparatus comprising:

developing means for developing said latent image with a developer incorporating a conductive abrasive with a volume resistivity ranging from $10^2$ to $10^{10}$ Ω·cm;

an electrophotographic photo-sensitive drum as said photo-sensitive drum, said surface layer thereof having, at least on the upper surface side, a hardness range being sufficient to permit its polishing by said abrasive;

wherein said photo-sensitive drum is an electrophotographic photo-sensitive drum with said surface layer thereof being represented by an elementary ratio composition formula (a-$Si_{1-x}C_x$:H), x being $0.95 \leqq x < 1$, the dynamic indentation hardness of said surface layer on the upper surface side thereof being 300 kgf/mm$^2$ or below, the hardness of said surface layer being higher on the inner side of said photoconductive layer than on the surface side.

11. An electrophotographic apparatus, in which a latent image formed on a photo-sensitive drum having a photoconductive layer and a surface layer, these layers being laminated on a base, is developed by causing selective toner attachment, said electrophotographic apparatus comprising:

developing means for developing said latent image with a developer incorporating a conductive abrasive with a volume resistivity ranging from $10^2$ to $10^{10}$ Ω·cm;

an electrophotographic photo-sensitive drum as said photo-sensitive drum, said surface layer thereof having, at least on the upper surface side, a hardness range being sufficient to permit its polishing by said abrasive;

wherein said photo-sensitive drum is an electrophotographic photo-sensitive drum with said surface layer thereof represented by an elementary ratio composition formula (a-$Si_{1-x}C_x$:H), x being $0.95 \leqq x < 1$, the dynamic indentation hardness of said surface layer on the upper surface side thereof being 300 kgf/mm$^2$ or below, the hardness of said inner surface layer being gradually increasing as one goes from said outer surface side toward the inner side of said photoconductive layer.

* * * * *